United States Patent [19]

Shehata et al.

[11] Patent Number: 5,052,675

[45] Date of Patent: Oct. 1, 1991

[54] TOP VACUUM CORRUGATION FEEDER WITH AERODYNAMIC DRAG SEPARATION

[75] Inventors: Ahmed-Mohsen Shehata, Penfield; David J. Lemmon, Hilton, both of N.Y.

[73] Assignee: Xerox Corporation, Stamford, Conn.

[21] Appl. No.: 541,661

[22] Filed: Jun. 21, 1990

[51] Int. Cl.[5] ..... B65H 3/14

[52] U.S. Cl. ..... 271/98; 271/94

[58] Field of Search ..... 271/97, 98, 94

[56] References Cited

U.S. PATENT DOCUMENTS 3,424,453 1/1969 Halbert ..... 271/35
4,306,684 12/1981 Peterson ..... 239/597
4,451,028 5/1984 Holmes et al. ..... 271/11
4,596,385 6/1986 Silverberg ..... 271/98 X
4,627,605 12/1986 Roller ..... 271/98 X
4,699,369 10/1987 Zirilli ..... 271/94

*Primary Examiner*—Richard A. Schacher
*Attorney, Agent, or Firm*—William A. Henry, II

[57] ABSTRACT

A top vacuum corrugation feeder employs a vacuum feedhead working in conjunction with an air knife to feed sheets from the top of a stack. The air knife employs a thick boundary layer of air at a low pressure to suspend and separate the sheets by aerodynamic drag, resulting in about a 50% reduction in the required power for operation of conventional top vacuum corrugation feeders.

11 Claims, 4 Drawing Sheets

TOP VACUUM CORRUGATION FEEDER WITH AERODYNAMIC DRAG SEPARATION

BACKGROUND OF THE INVENTION

This invention relates to an electrophotographic printing machine, and more particularly, concerns an improved air knife of a top vacuum corrugation feeder for such a machine.

Present high speed xerographic copy reproduction machines produce copies at a rate in excess of several thousand copies per hour, therefore, the need for a sheet feeder to feed cut copy sheets to the machine in a rapid, dependable manner has been recognized to enable full utilization of the reproduction machine's potential copy output. In particular, for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

In addition, currently existing paper feeders, e.g., forward buckle, reverse buckle, corrugating roll, etc., are very sensitive to coefficients of friction of component materials and to sheet material properties as a whole.

One of the sheet feeders best known for high speed operation is the top vacuum corrugation feeder with front air knife. In this system, a vacuum plenum with a plurality of friction transport belts arranged to run over the vacuum plenum is placed at the top of a stack of sheets in a supply tray. At the front of the stack, an air knife is used to inject air into the stack to separate the top sheet from the remainder of the stack. In operation, the vacuum pulls the top sheet up and acquires it while air is injected by the air knife towards the stack to assure the separation of the top sheet from the rest of the stack. Following acquisition and seapration, the belt transport drives the sheet forward off the stack of sheets. In this configuration, separation of the next sheet cannot take place until the top sheet has cleared the stack. In this type of feeding system every operation takes place in succession or serially and therefore the feeding of subsequent sheets cannot be started until the feeding of the previous sheet has been completed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets. Also, current top and bottom vacuum corrugation feeders utilize a valved vacuum feedhead, e.g., U.S. Pat. Nos. 4,269,406 and 4,451,028 which are included herein by reference. At the appropriate time during the feed cycle the valve is actuated, establishing a flow and hence a negative pressure field over the stack top or bottom if a bottom vacuum corrugation feeder is employed. This field causes the movement of the top sheet(s) to the vacuum feedhead where the sheet is then transported to the take-away rolls. Once the sheet feed edge is under control of the take-away rolls, the vacuum is shut off. The trail edge of this sheet exiting the feedhead area is the criteria for again activating the vacuum valve for the next feeding.

Other prior art feeder systems that may be relevant are as follows:

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition, an ail blast is directed to the leading edge of a stack of sheets from which the sheet is to be separated and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al.) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

U.S. Pat. No. 4,418,905 (Garavuso) shows a bottom vacuum corrugation feeding system.

U.S. Pat. No. 4,451,028 (Holmes et al.) discloses a top feed vacuum corrugation feeding system that employs front and back vacuum plenums.

U.S. Pat. Nos. 868,317 (Allen); 1,721,608 (Swart et al.); 1,867,038 (Uphan); 2,224,802 (Spiess); 3,041,067 (Fux et al.); 3,086,771 (Goin et al.); 3,770,266 (Wehr et al.); and 4,382,593 (Beran et al.); all disclose sheet feeders in which a blower appears to be angled at sheets.

U.S. Pat. Nos. 3,837,639 (Phillips) and 4,306,684 (Peterson) relate to the use of air nozzles to either separate or maintain sheet separation.

U.S. Pat. No. 3,171,647 (Bishop) describes a suction feed mechanism for cardboard and like blanks that employs a belt which is intermittently driven.

U.S. Pat. No. 3,260,520 (Sugden) is directed to a document handling apparatus that employs a vacuum feed system and a vacuum reverse feed belt adapted to separate doublets.

U.S. Pat. No. 3,614,089 (Van Auken) relates to an automatic document feeder that includes blowers to raise a document up against feed belts for forward transport. Stripper wheels are positioned below the feed belts and adapted to bear against the lower surface of the lowermost document and force it back into the document stack.

U.S. Pat. No. 4,699,369 (Zirilli) is directed to a top vacuum corrugation feeder that employs an air knife that includes trapezodial shaped fluffer jets to enhance high speed feeding of a variety of paper weights.

IBM Technical Disclosure Bulletin entitled "Document Feeder and Separator", Vol. 6, No. 2, page 32, 1963 discloses a perforated belt that has a vacuum applied through the perforations in the belt in order to lift documents from a stack for transport. The belt extends over the center of the document stack.

The above-mentioned disclosures are included herein by reference to the extent necessary to practice the present invention.

It will be appreciated that while vacuum feeders have the advantages of high reliability and of generating less paper debris than, for example, friction retard feeders, and hence minimizing a significant dirt source in the machine, the paper debris affects the reliability and the quality of performance of many subassemblies, in particular, the photoreceptor. Conversely, the air power consumption is extremely high, specifically when recognizing that motor-blower efficiency is typically low. High power consumption is a barrier toward using vacuum feeders in low and middle volume machines.

SUMMARY OF THE INVENTION

Accordingly, an air drag separation, low power, low noise and low cost top vacuum corrugation feeder is disclosed that includes an improved single rectangular slot air knife/feed head configurations, that provides for sheet separation and suspension using a thick boundary layer under the feed head, at low pressure, to separate sheets at the top of the paper stack by aerodynamic drag. This configuration results in a 50% reduction in power previously required for operation of a top vacuum corrugation feeder, as well as noise and cost reductions.

DESCRIPTION OF THE PREFERRED EMBODIMENT

While the present invention will be described hereinafter in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
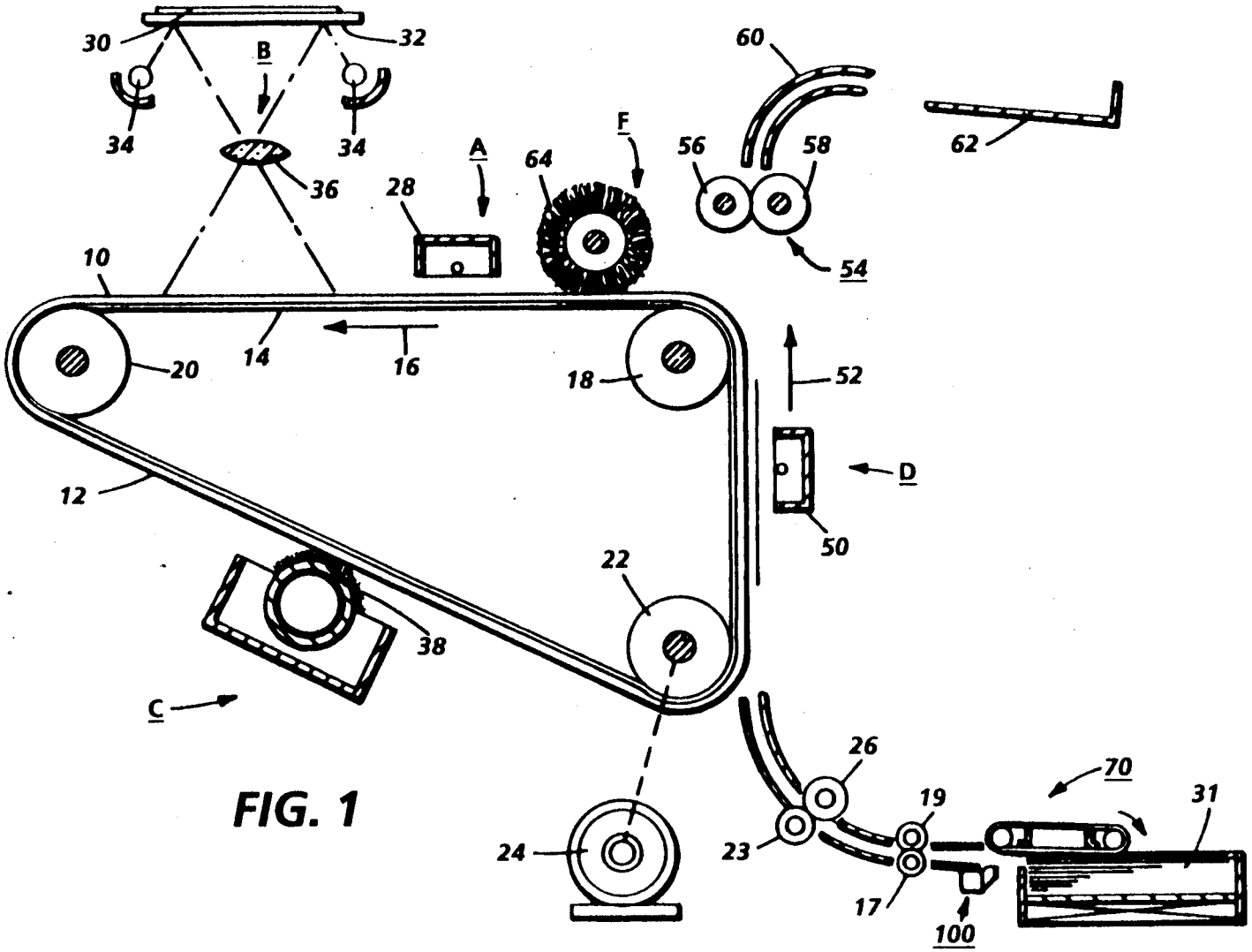
FIG. 1 is a schematic elevation view of an electrophotographic printing machine incorporating the features of the present invention therein.

For a general understanding of the features of the present invention, reference is had to the drawings. In the drawings, like reference numerals have been used throughout to designate identical elements. FIG. 1 schematically depicts the various components of an illustrative electrophotographic printing machine incorporating the top feed vacuum corrugation feeder method and apparatus of the present invention therein. It will become evident from the following discussion that the sheet feeding system disclosed herein is equally well suited for use in a wide variety of devices and is not necessarily limited to its application to the particular embodiment shown herein. For example, the apparatus of the present invention may be readily employed in non-xerographic environments and substrate transportation in general.

Inasmuch as the art of electrophotographic printing is well known, the various processing stations employed in the FIG. 1 printing machine will be shown hereinafter schematically and the operation described briefly with reference thereto.

As shown in FIG. 1, the electrophotographic printing machine employs a belt 10 having a photo conductive surface 12 deposited on a conductive substrate 14. Belt 10 moves in the direction of arrow 16 to advance successive portions of photo conductive surface 12 sequentially through the various processing stations disposed about the path of movement thereof. Belt 10 is entrained around stripper roller 18, tension roller 20, and drive roller 22.

Drive roller 22 is mounted rotatable in engagement with belt 10. Roller 22 is coupled to a suitable means such as motor 24 through a belt drive. Motor 24 rotates roller 22 to advance belt 10 in the direction of arrow 16. Drive roller 22 includes a pair of opposed spaced flanges or edge guides (not shown). Preferably, the edge guides are circular members or flanges.

Belt 10 is maintained in tension by a pair of springs (not shown), resiliently urging tension roller 20 against belt 10 with the desired spring force. Both stripping roller 18 and tension roller 20 are mounted rotatable. These rollers are idlers which rotate freely as belt 10 moves in the direction of arrow 16.

With continued reference to FIG. 1, initially a portion of belt 10 passes through charging station A. At charging station A, a corona generating device, indicated generally by the reference numeral 28, charges photo conductive surface 12 of the belt 10 to a relatively high, substantially uniform potential.

Next, the charged portion of photo conductive surface 12 is advanced through exposure station B. At exposure station B, an original document 30 is positioned face down upon transparent platen 32. Lamps 34 flash light rays onto original document 30. The light rays reflected from the original document 30 are transmitted through lens 36 from a light image thereof. The light image is projected onto the charged portion of the photo conductive surface 12 to selectively dissipate the charge thereon. This records an electrostatic latent image on photo conductive surface 12 which corresponds to the information areas contained within original document 30.

Thereafter, belt 10 advances the electrostatic latent image recorded on photo conductive surface 12 to development station C. At development station C, a magnetic brush developer roller 38 advances a developer mix into contact with the electrostatic latent image. The latent image attracts the toner particles from the carrier granules forming a toner powder image on photo conductive surface 12 of belt 10.

Figure 2:
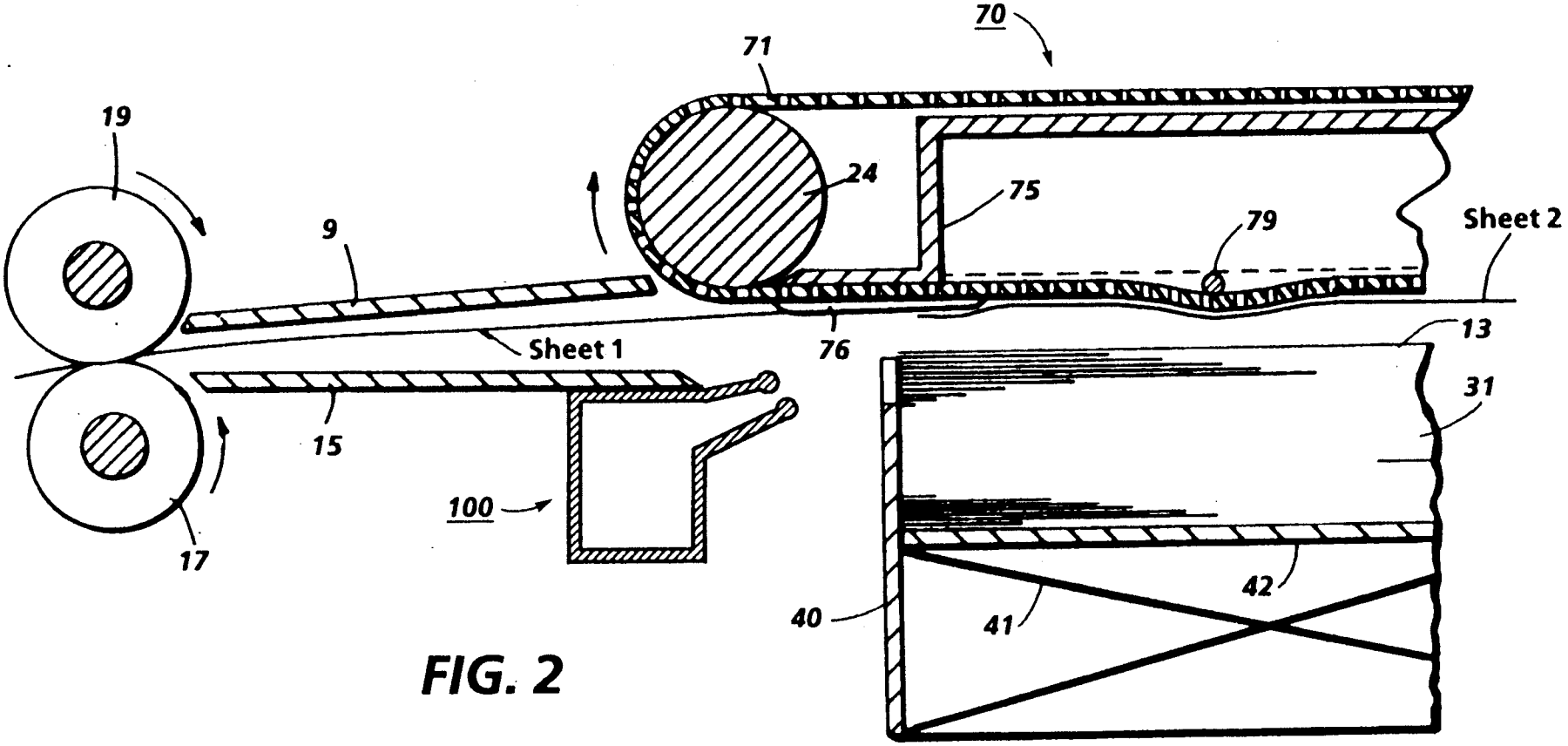
FIG. 2 is an enlarged partial cross-sectional view of the exemplary feeder in FIG. 1 which is employed in accordance with the present invention.

Belt 10 then advances the toner powder image to transfer station D. At transfer station D, a sheet of support material is moved into contact with the toner powder image. The sheet support material is advanced toward transfer station D by top vacuum corrugation feeder 70. Preferably, the feeder includes an air knife 100 in accordance with the present invention which floats a sheet 31 up to where it is grabbed, by the suction force from vacuum plenum 75 (FIG. 2). A perforated feed belt 71 then forwards the now separated sheet for further processing, i.e., the sheet is directed through rollers 17, 19, 23, and 26 (FIG. 1) into contact with the photo conductive surface 12 of belt 10 in a timed sequence by suitable conventional means so that the toner powder image developed thereon synchronously contacts the advancing sheet of support material at transfer station D.

Transfer station D includes a corona generating device 50 which sprays ions onto the backside of a sheet passing through the station. This attracts the toner powder image from the photo conductive surface 12 to the sheet and provides a normal force which causes photo conductive surface 12 to take over transport of the advancing sheet of support material. After transfer, the sheet continues to move in the direction of arrow 52 onto a conveyor (not shown) which advances the sheet to fusing station E.

Fusing station E includes a fuser assembly, indicated generally by the reference number 54, which permanently affixes the transferred toner powder image to the substrate. Preferably, fuser assembly 54 includes a heated fuser roller 56 and a backup roller 58. A sheet passes between fuser roller 56 and backup roller 58 with the toner powder image contacting fuser roller 56. In this manner, the toner powder image is permanently affixed to the sheet. After fusing, chute 60 guides the advancing sheet to catch tray 62 for removal from the printing machine by the operator.

Invariably, after the sheet support material is separated from the photo conductive surface 12 of belt 10, some residual particles remain adhering thereto. These residual particles are removed from photo conductive surface 12 at cleaning station F. Cleaning station F includes a rotatable mounted brush 64 in contact with the photo conductive surface 12. The particles are cleaned from photo conductive surface 12 by the rotation of brush 64 in contact therewith. Subsequent to cleaning, a discharge lamp (not shown) floods photo conductive surface 12 with light to dissipate any residual electrostatic charge remaining thereon prior to the charging thereof for the next successive image cycle.

It is believed that the foregoing description is sufficient to illustrate the general operation of an electrostatographic machine.

Figure 3:
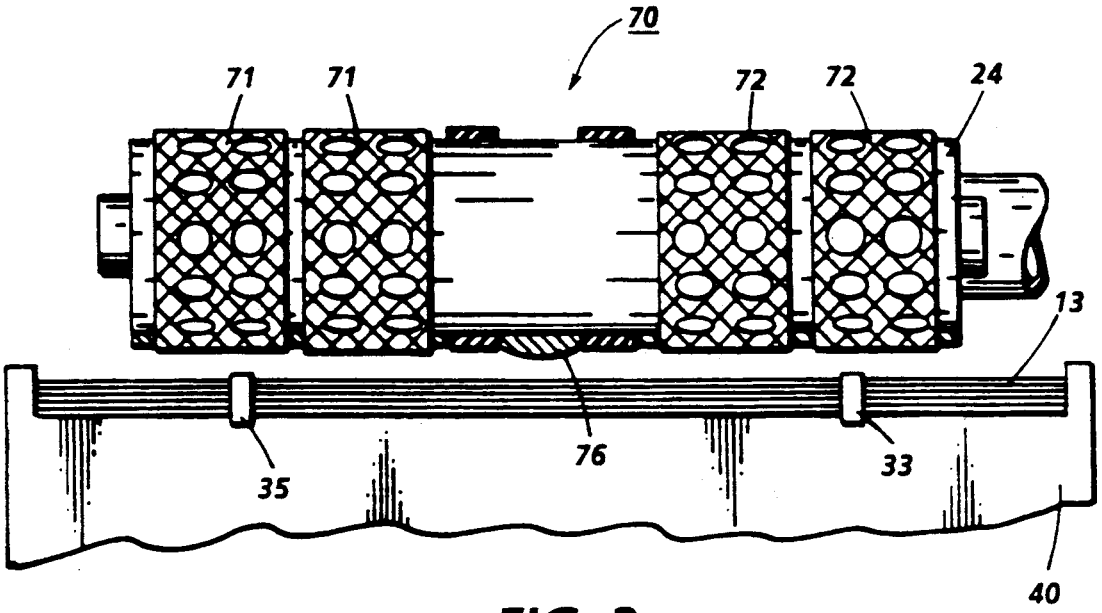
FIG. 3 is a partial front end view of the paper tray shown in FIG. 2.

Referring now to FIGS. 2 and 3, FIG. 2 shows a system employing the present invention in a copy sheet feeding mode. Alternatively, or in addition, the sheet feeder may be mounted for feeding document sheets to the platen of a printing machine. The sheet feeder is provided with either a spring tray or a conventional elevator mechanism 41 for raising and lowering either tray 40 or a platform 42 within tray 40. Ordinarily in a conventional elevator mechanism, a drive motor is actuated to move the sheet stack support platform 42 vertically by a stack height sensor positioned above the rear of the stack when the level of sheets relative to the sensor falls below a first predetermined level. The drive motor is deactivated by the stack height sensor when the level of the sheets relative to the sensor is at a predetermined level. In this way, the level of the top sheet in the stack of sheets may be maintained within defined limits to assure proper sheet separation, acquisition and feeding.

Vacuum corrugation feeder 70 and a vacuum plenum 75 are positioned over the front end of a tray 40 having copy sheets 31 stacked therein. Belts 71 are entrained around drive rollers 24 as well as plenum 75. Belts 71 could be made into a single belt if desired. Perforations 72 in the belts (FIG. 3) allow a suitable vacuum source (not shown) to apply a vacuum through plenum 75 and belts 71 to acquire sheets 13 from stack 31. Air knife 100 applies a positive pressure to the front of stack 31 to separate the top sheet in the stack and enhance its acquisition by vacuum plenum 75. Corrugation rail 76 and cross corrugator 79 are attached or molded into the underside and center of plenum 75 and cause sheets acquired by the vacuum plenum to bend during acquisition so that if a second sheet is still sticking to the sheet having been acquired by the vacuum plenum, the corrugation and air flow will cause the second sheet to detach. A sheet acquired on belts 71 is forwarded through baffles 9 and 15 and into forwarding drive rollers 17 and 19 for transport to transfer station D. In order to prevent sheet multifeeding from tray 40, a pair of restriction members 33 and 35 (FIG. 3) are attached to the upper front end of tray 40 and serve to inhibit all sheets other than sheet 1 from leaving the tray. It is also possible to place these restriction members or fangs on the air knife instead of the tray or totally eliminate them.

Figure 4:
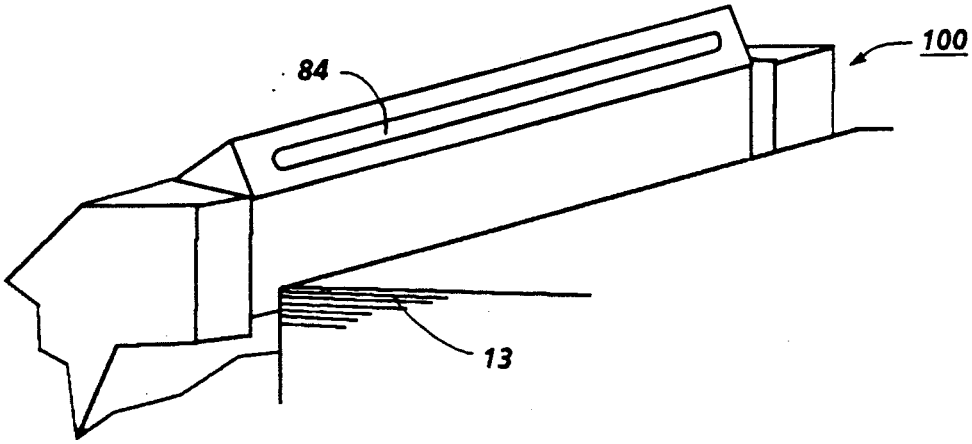
FIG. 4 is a partial isometric view of the air knife of the present invention showing the large slot fluffer jet of the present invention in relation to a sheet stack.
Figure 5:
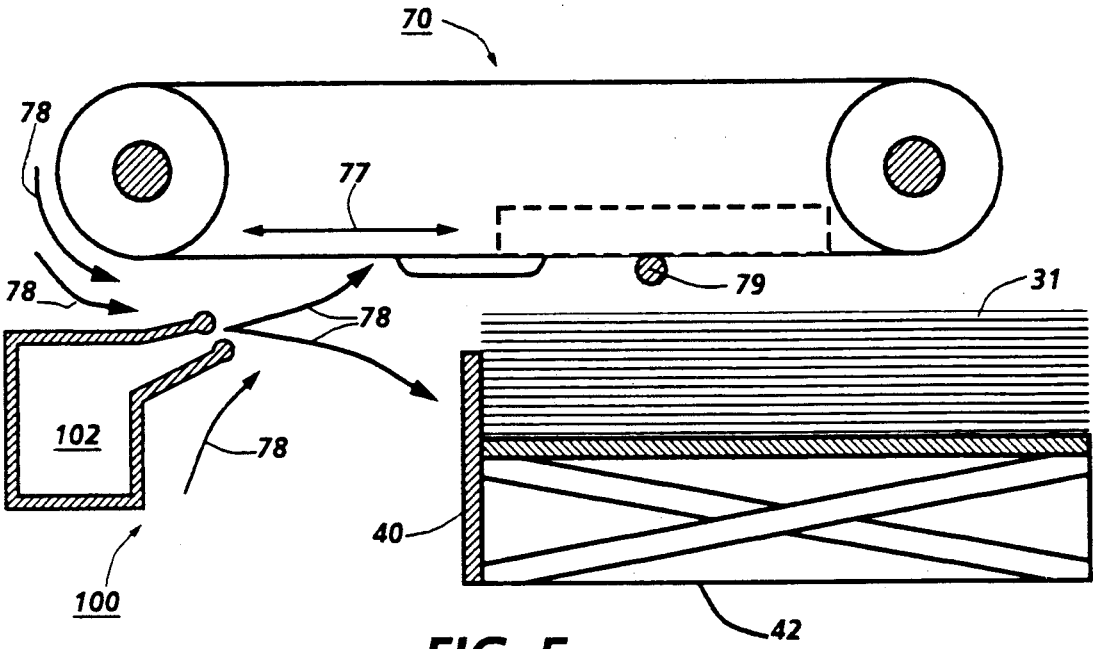
FIG. 5 is a schematic of the present configuration presenting the air knife, stack and feedhead configuration with air entrainment.
Figure 6:
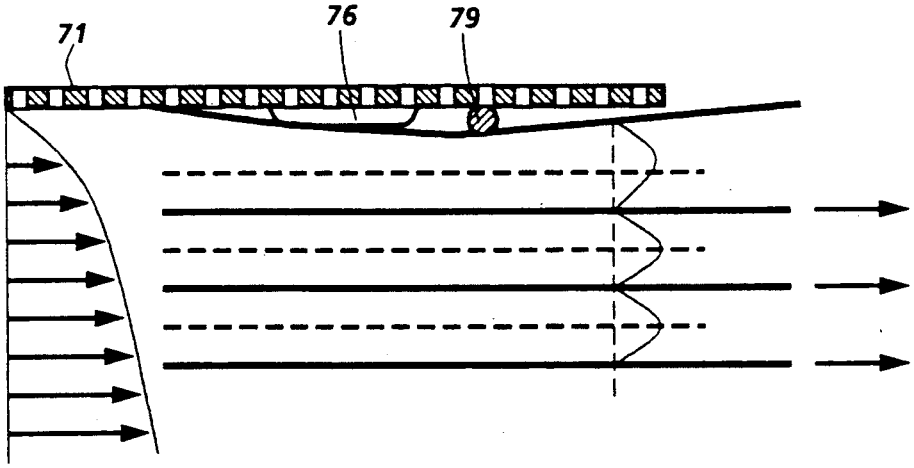
FIG. 6 shows the velocity profile of the air in front of the stack and between the sheets which causes aerodynamic drag separation.

The improved air knife 100 shown in greater detail in FIGS. 4–6 contains a single large slot 84 for the exit of air supplied thereto by pressurized air plenum 102. The air knife slot 84, the vacuum feedhead and the sheet stack are positioned so that as an air stream emerges from slot 84, entrainment of air occurs as seen in FIG. 5 along flow developing length 77 of feedhead 70 as well as along the face of sheets 31 in tray 40 as shown by arrows 78. As shown in FIG. 6, this entrainment of air causes a thickened boundary layer of air along the front end of sheet stack 31, fluffing the top sheets of the stack. The air when passing between the sheets separates the sheets by aerodynamic drag as shown by the velocity profiles in FIG. 6.

In the past, top vacuum corrugation feeders relied on a sheet separating mechanism that applied a high pressure on a sheet stack front portion (thumb print). The present invention in contrast achieves a reduction in air power of about 50% by minimizing the opposing forces on top of the sheet that exist in current top vacuum corrugation feeders (thumb print, positive pressure, and vacuum, negative pressure) with an air knife/feed head configuration that utilizes approximately the same air knife flow rate as previously used, but at a significantly lower pressure in order to create a thick boundary layer under the vacuum feedhead that separates the sheets by aerodynamic drag. This method of separation will keep the sheets suspended which in turn allows the acquisition of the sheets at a significantly lower vacuum flow rate, thus the 50% air power reduction is achieved.

It should now be apparent that an air flow design for sheet separation has been disclosed in the form of an air knife with a large slot that uses a thick boundary layer at low pressure to separate sheets in a stack by aerodynamic drag along with lowered vacuum flow requirement, resulting in about a 50% reduction in the power required for operation of a top vacuum corrugation feeder, as well as, noise and cost reduction.

In addition to the method and apparatus disclosed above, other modifications and/or additions will readily appear to those skilled in the art upon reading this disclosure and are intended to be encompassed within the invention disclosed and claimed herein.

What is claimed is:

1. A top sheet feeding apparatus that operates with reduced air pressure, comprising: a sheet stack support tray for supporting a stack of sheets within the tray, low pressure air knife means positioned in front of said stack of sheets for applying a positive low air pressure through an exit portion thereof to the sheet stack in order to suspend and separate the top sheets in the stack from the rest of the stack, and feedhead means including a vacuum plenum chamber positioned over the front of the sheet stack with a portion thereof extending beyond the front of the sheet stack and having a negative pressure applied thereto during feeding, said vacuum plenum chamber having sheet corrugation members located in the center of its bottom surface and perforated feed belt means associated with said vacuum plenum chamber to transport the sheets acquired by said vacuum plenum chamber in a forward direction out of the stack support tray, and wherein said air knife means includes a single large slot in said exit portion spanning substantially the entire width of said air knife that is configured for air entrainment such that air pressure supplied therethrough creates a thick boundary layer at a low pressure along a portion of said feedhead and the front of the sheet stack.

2. The top sheet feeding apparatus of claim 1, wherein said slot is orthogonal to the direction of flow of air from said air knife and extends over a major portion of the exit portion of said air knife.

3. The top sheet feeding apparatus of claim 1, wherein one of said sheet corrugation members is positioned orthogonally to another of said sheet corrugation members.

4. A low cost, low vacuum and air power top sheet feeding apparatus comprising a sheet stack support tray for supporting a stack of sheets within the tray, low pressure air knife means positioned in front of said stack of sheets for applying a positive low air pressure through an exit portion thereof to the sheet stack in order to suspend and separate the top sheets in the stack from the rest of the stack, and feedhead means including a vacuum plenum chamber positioned over the front of the sheet stack with a portion thereof extending beyond the front of the sheet stack and having a negative pressure applied thereto during feeding, and feed belt means associated with said vacuum plenum chamber to transport the sheets acquired by said vacuum plenum chamber in a forward direction out of the stack support tray, and wherein said air knife means includes a single large slot in said exit portion spanning substantially the entire width of said air knife that is configured for air entrainment such that air pressure supplied therethrough creates a thick boundary layer at a low pressure along a portion of said feedhead as well as the front of the sheet stack in order to suspend sheets in the stack and thereby enhance feeding of the sheets from the stack.

5. The top sheet feeding apparatus of claim 4, wherein said vacuum plenum chamber includes sheet corrugation members located in the center of its bottom surface.

6. The top sheet feeding apparatus of claim 5, wherein one of said sheet corrugation members is positioned orthogonally to another of said sheet corrugation members.

7. The top sheet feeding apparatus of claim 4, wherein said feed belt means include perforations therethrough in order to allow vacuum pressure from said vacuum plenum chamber to reach said stack of sheets.

8. A low cost, low vacuum and air power top sheet feeding apparatus comprising a sheet stack support tray for supporting a stack of sheets within the tray, low pressure air knife means positioned in front of said stack of sheets for applying a positive low air pressure through an exit portion thereof to the sheet stack in order to suspend and separate the top sheets in the stack from the rest of the stack, and feedhead means including a vacuum plenum chamber positioned over the front of the sheet stack with a portion thereof extending beyond the front of the sheet stack and having a negative pressure applied thereto during feeding, and feed belt means associated with said vacuum plenum chamber to transport the sheets acquired by said vacuum plenum chamber in a forward direction out of the stack support tray, and wherein said air knife means includes a single large slot in said exit portion spanning substantially the entire width of said air knife that is configured for air entrainment in order to present a low pressure flow rate to said sheet stack in order to create a thick boundary layer under said vacuum feedhead that separates said sheets by aerodynamic drag as well as keep said sheets suspended in order to thereby enhance feeding of the sheets from the stack by said vacuum feedhead.

9. The top sheet feeding apparatus of claim 8, wherein said vacuum plenum chamber includes sheet corrugation members located in the center of its bottom surface.

10. The top sheet feeding apparatus of claim 9, wherein one of said sheet corrugation members is positioned orthogonally to another of said sheet corrugation members.

11. The top sheet feeding apparatus of claim 8, wherein said feed belt means include perforations therethrough in order to allow vacuum pressure from said vacuum plenum chamber to reach said stack of sheets.

* * * * *